US011814218B2

(12) United States Patent
Reiley et al.

(10) Patent No.: US 11,814,218 B2
(45) **Date of Patent: *Nov. 14, 2023**

(54) LID FOR CONTAINERS AND RELATED METHODS

(71) Applicants: Nadiah Reiley, La Jolla, CA (US); Adrian Reiley, La Jolla, CA (US)

(72) Inventors: Nadiah Reiley, La Jolla, CA (US); Adrian Reiley, La Jolla, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/584,180

(22) Filed: Jan. 25, 2022

(65) Prior Publication Data

US 2022/0144504 A1 May 12, 2022

Related U.S. Application Data

(63) Continuation-in-part of application No. 16/904,406, filed on Jun. 17, 2020, now Pat. No. 11,230,414,
(Continued)

(51) Int. Cl.

| | |
|---|---|
| ***B65D 47/08*** | (2006.01) |
| ***B65D 43/02*** | (2006.01) |
| ***B65D 47/32*** | (2006.01) |
| ***B65D 51/16*** | (2006.01) |
| ***B65D 81/18*** | (2006.01) |

(Continued)

(52) U.S. Cl.
CPC ..... *B65D 47/08* (2013.01); *B65D 43/0212* (2013.01); *B65D 47/32* (2013.01); *B65D 51/1644* (2013.01); *B65D 51/24* (2013.01); *B65D 51/245* (2013.01); *B65D 51/28* (2013.01);
(Continued)

(58) Field of Classification Search
CPC ..... B65B 7/168; B65B 7/2842; B65B 25/02; B65D 43/169; B65D 51/1644; B65D 51/245; B65D 51/248; B65D 51/28; B65D 51/30; B65D 2251/0018; B65D 2251/0021; B65D 2251/1016; A24F 25/00; A24F 25/02
USPC ..... 53/400, 428, 485, 286; 73/29.02; 206/204, 213.1; 209/675, 370, 373, 401,
(Continued)

(56) References Cited

U.S. PATENT DOCUMENTS 430,643 A * 6/1890 Hamm ..... A24F 25/02 312/31.1
437,321 A * 9/1890 Young et al. ..... A24F 25/02 217/89
(Continued)

FOREIGN PATENT DOCUMENTS

CH 694145 A5 * 8/2004 ..... A24F 25/02
GB 2178939 A * 2/1987 ..... A24F 25/02
(Continued)

*Primary Examiner* — Stephen F. Gerrity
(74) *Attorney, Agent, or Firm* — Buche & Associates, P.C.; John K. Buche; Bryce A. Johnson

(57) ABSTRACT

A lid designed to allow a user to see and adjust the humidity levels of a container using a hygrometer and pocket for humidity packs. The lid also allows this to be accomplished without removing the lid because a hatch gives the user access to the inside of the container and underside of the lid, where the pocket is located. Also, the hatch on the lid provides a more efficient and easier method of accessing the contents of a container because a user can simply open and close a hatch, instead of needing to unlock a lever locking latch to remove a lid.

12 Claims, 19 Drawing Sheets

Related U.S. Application Data which is a continuation-in-part of application No. 15/860,591, filed on Jan. 2, 2018, now Pat. No. 10,723,535, which is a continuation-in-part of application No. 29/631,054, filed on Dec. 27, 2017, now Pat. No. Des. 859,155.

(51) Int. Cl.
*B65D 51/24* (2006.01)
*B65D 51/28* (2006.01)

(52) U.S. Cl.
CPC .... *B65D 81/18* (2013.01); *B65D 2543/00537* (2013.01)

(58) Field of Classification Search
USPC ..... 209/403; 220/254.3, 522, 833–835; 312/31.1
See application file for complete search history.

(56) References Cited

U.S. PATENT DOCUMENTS 920,318 A * 5/1909 Garland ..... B07B 1/46 209/403
1,534,339 A * 4/1925 Perry ..... B65D 51/30 96/148
1,564,638 A * 12/1925 Stanton ..... A47J 43/22 209/403
1,589,871 A * 6/1926 Brunhoff ..... A24F 25/02 239/57
1,637,656 A * 8/1927 Radcliffe ..... B65F 7/00 220/908
1,646,702 A * 10/1927 Moyer ..... A47F 3/145 215/244
1,698,320 A * 1/1929 Sharp ..... B65D 51/30 96/148
1,999,554 A * 4/1935 Zucker ..... A24F 25/02 220/908
2,202,796 A * 5/1940 Hermani ..... A24F 23/00 220/521
2,465,890 A * 3/1949 Levy ..... F24F 6/12 239/58
2,546,599 A * 3/1951 Hicks ..... A24F 25/02 312/31.1
2,680,048 A * 6/1954 McDonald ..... A23L 3/3418 312/31.1
2,819,135 A * 1/1958 Shapiro ..... A24F 25/02 239/57
2,989,219 A * 6/1961 Overton ..... B65D 15/04 229/5.7
2,989,220 A * 6/1961 Overton ..... B65D 15/22 229/5.7
3,005,571 A * 10/1961 Hall ..... E05C 19/066 220/254.3
4,008,930 A * 2/1977 Swainson ..... A24F 25/02 312/31.1
4,307,808 A * 12/1981 Johnson ..... A47J 43/22 209/675
5,129,537 A * 7/1992 Bordner et al. ..... B65D 45/345 292/256.69
5,215,196 A * 6/1993 Valls ..... B07B 1/46 426/115
5,485,923 A * 1/1996 Schrepfer ..... B07B 1/00 209/373
5,556,579 A * 9/1996 Newman ..... B65D 81/268 261/99
5,803,247 A * 9/1998 Holmes et al. ..... A24F 25/02 206/256
5,901,710 A * 5/1999 Barber ..... A24F 25/00 206/256
5,957,380 A * 9/1999 Fitterman et al. ..... A24F 25/02 239/54
6,068,113 A * 5/2000 Schmaling et al. . A45C 13/103 312/31.1
6,094,917 A * 8/2000 Sundhar et al. ..... H01L 35/00 62/3.4
10,634,428 B1 * 4/2020 Peter ..... F26B 25/08
10,723,535 B2 * 7/2020 Reiley et al. ..... B65D 51/245
10,779,567 B1 * 9/2020 Alexander ..... A24F 25/02
11,230,414 B2 * 1/2022 Reiley et al. ..... B65D 51/24
2003/0217489 A1 * 11/2003 Witkowski ..... G09F 3/10 40/306
2006/0024463 A1 * 2/2006 Gustafson et al. ..... G09F 3/10 428/40.1
2007/0227913 A1 * 10/2007 Shoenfeld ..... E05B 63/24 206/1.5
2013/0126380 A1 * 5/2013 LoPiccolo et al. .. B65D 5/0227 221/48
2013/0220845 A1 * 8/2013 Smith ..... A24F 25/02 206/213.1
2014/0113272 A1 * 4/2014 Schefke ..... B43L 1/10 434/408
2016/0137345 A1 * 5/2016 Grodsky et al. ..... A61C 1/082 206/505
2017/0096279 A1 * 4/2017 Campalans et al. ..... B65D 81/2076
2017/0313482 A1 * 11/2017 Herlin et al. ..... A24F 23/00
2019/0031410 A1 * 1/2019 Vazquez ..... B65D 1/10

FOREIGN PATENT DOCUMENTS

JP 2009034498 A * 2/2009 ..... A47G 33/02
WO WO-2016188690 A1 * 12/2016 ..... A24F 25/00

* cited by examiner

REPLACEMENT SHEET 17/19

LID FOR CONTAINERS AND RELATED METHODS

CROSS-REFERENCE TO RELATED APPLICATIONS

This application is a continuation in part of U.S. patent application Ser. No. 16/904,406, filed on Jun. 17, 2020, now U.S. Pat. No. 11,230,414, which is a continuation in part of U.S. patent application Ser. No. 15/860,591, filed on Jan. 2, 2018, now U.S. Pat. No. 10,723,535, which is a continuation in part of U.S. patent application Ser. No. 29/631,054, filed Dec. 27, 2017, now U.S. Pat. No. Des. 859,155.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO AN APPENDIX SUBMITTED ON A COMPACT DISC AND INCORPORATED BY REFERENCE OF THE MATERIAL ON THE COMPACT DISC

Not applicable.

STATEMENT REGARDING PRIOR DISCLOSURES BY THE INVENTOR OR A JOINT INVENTOR

Reserved for a later date, if necessary.

BACKGROUND OF THE INVENTION

Field of Invention

The disclosed subject matter relates to lids and covers for containers. More specifically, the disclosed subject matter relates to lids for drums that are used to store agricultural products, which allow for easy access to the contents and humidity reading and control.

Background of the Invention

Fibrous drums and other containers are frequently used to store agricultural products such as grains or plant-based products. Many plant-based crops thrive at a certain level of humidity. Therefore, when there is a loss of water vapor or a less than optimal humidity level, the agricultural product may be negatively affected. Currently, traditional lids for fiber drums, plastic drums, and other containers do not have a means for checking the humidity of a certain environment by just looking at the lid. Therefore, a need exists for a lid with a hygrometer for commercial sized agricultural containers.

Moreover, lids for commercial containers generally use a lever locking mechanism that makes it cumbersome to secure and remove the lid from the container.

US patents exist for clamping and securing a lid to a drum and for controlling humidity within a container, however, these patents do not provide for easy access to the contents of a container, while having the ability to monitor and adjust the humidity. U.S. Pat. No. 5,129,537 by Bordner et al. provides a lid clamping ring for a lid for a fibrous drum. This patent does not allow for easy access to the contents of a container, because the clamping ring needs to be unlocked and the lid needs to be removed before a user can access the container. U.S. Pat. No. 5,556,579 to Newman provides a jar cover with humidity control. However, this product is not configured to be used for commercial drums and does not have a hatch for easy access to the contents of a container without having to remove the lid.

Accordingly, a need exists for a lid that allows a user to access the contents of a container without needing to unlatch and remove the entire lid from the container, while giving the user the ability to monitor and adjust the humidity within a container.

SUMMARY OF THE INVENTION

In view of the foregoing, an object of this invention to provide a lid for containers that allows a user to monitor the humidity within a container.

Another objective of the invention is to provide a means for a user to adjust the humidity within a container. Another objective of the invention is to provide a lid that does not use the lever locking latch that is common for most lids for storage drums.

Another objective of the invention is to provide a hatch on a lid so that a user can easily access the contents of a container without needing to remove the lid.

Another objective of the invention is to provide means to regulate air exchange to and from the container wirelessly.

Another objective of the invention is to provide means to transmit container data wirelessly to a computer or mobile device.

Another objective of the invention is to provide means to automatically trim excess leaves and collect desirable extract within the container.

Another objective of the invention is to provide a surface for labels, so that a user can identify the contents of a container. Moreover, the surface may a dry erase surface or an area for a dry erase sticker, so that a user can easily erase and relabel the contents of a container.

Another objective of the invention is to provide a lid that protects the contents of a container from the oxidizing of air so as to allow for long-term storage.

Another objective of the invention is to provide a means for a user to easily access the contents at the bottom of a container without the need to empty the container.

Another objective of the invention is to provide a lid that can automatically equalize humidity levels to more accurately regulate the humidity within a container.

BRIEF DESCRIPTION OF THE SEVERAL VIEWS OF THE DRAWINGS

Other objectives of the disclosure will become apparent to those skilled in the art once the invention has been shown and described. The manner in which these objectives and other desirable characteristics can be obtained is explained in the following description and attached figures in which.

Figure 1:
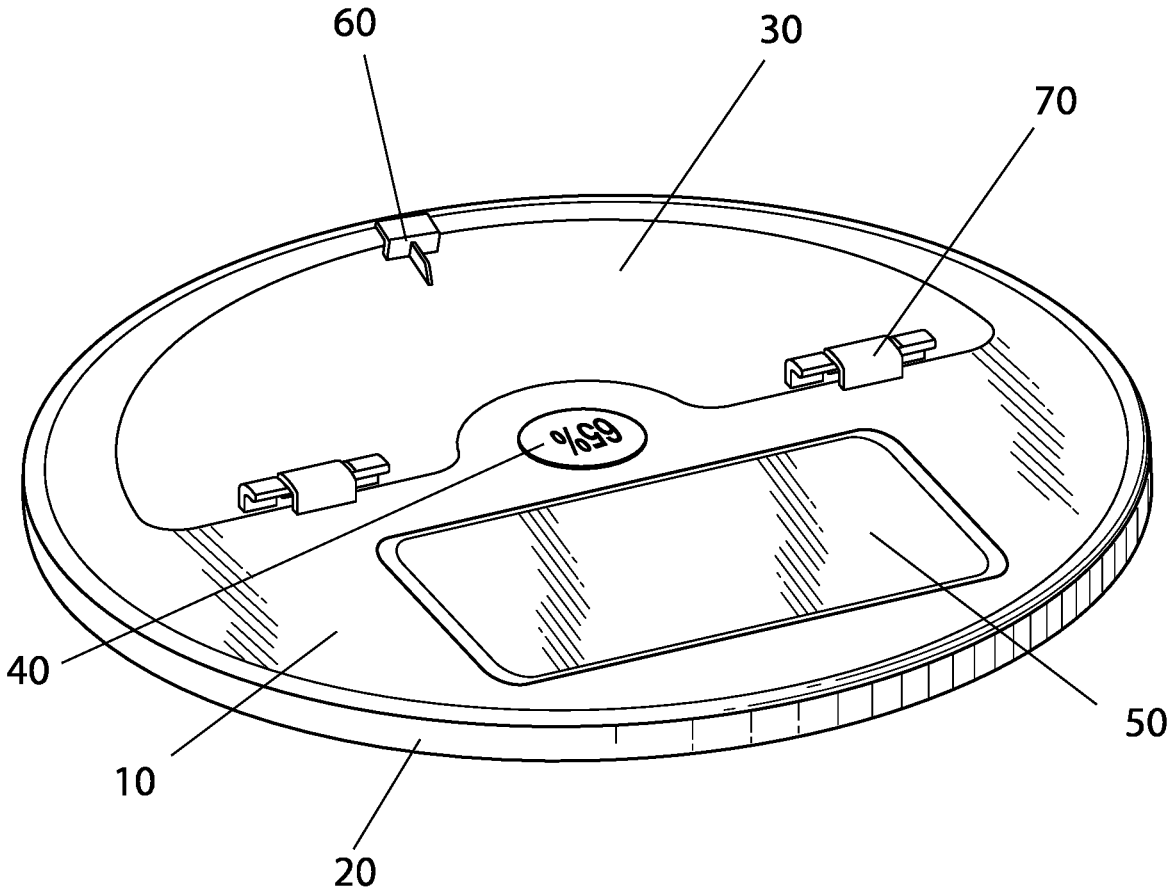
FIG. 1 is a perspective view of the lid for a container.

In the figures, the following items correspond to the associated reference numerals:

Lid—10;
Valve—11;
Valve hole—11*a;*
Void—11*b;*
Webbing—12;
Extract container—13;
Rim—20
Hatch—30;
Hygrometer—40;
Label—50;
Lock—60;
Hinges—70;
Pocket—80;
Lattice insert—90;
Lattice insert wall—91
Spacers—92;
Sifter Screen—95;
Powered pumps—100;
Powered intake pump—101;
Powered exhaust pump—102;
Bottom lid—110;
Bottom rim—111;
Trap door hatch—112;
Trap door hinge—113;
Preservation lid—120;
Preservation rim—121; and,
Preservation valve—122.

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

Disclosed is a lid for containers that allow users to monitor and change the humidity in a container, while providing easy access to the contents of a container.

FIG. 1 is a perspective view of the lid for a container. In a preferred embodiment, the lid 10 is used to cover containers and drums, such as a fiber drum, a plastic drum, or a drum of any other material. The lid 10 may have varying circumferences to fit various sizes of drums and containers. Referring to FIG. 1, the lid 10 features a hatch 30, which provides a means of accessing the contents of a container without having to remove the lid 10. This is beneficial because many containers require a tight seal around the edges, which is accomplished by using a lever locking ring. Locking and unlocking the lever locking ring to secure and remove the lid can be cumbersome and time consuming. Therefore, a simple locking hatch 30 allows the user to access, remove, and add contents to a container without needing to manipulate the lever locking rim and remove the lid. In an alternate embodiment the hatch 30 may be twisted. This twisting will open and close the hatch 30. Still referring to FIG. 1, the lid also features a hygrometer 40 to measure the humidity within the container and a label 50, wherein the surface for the label may be an erasable surface, such as a dry erase surface or a chalk board surface.

Figure 2:
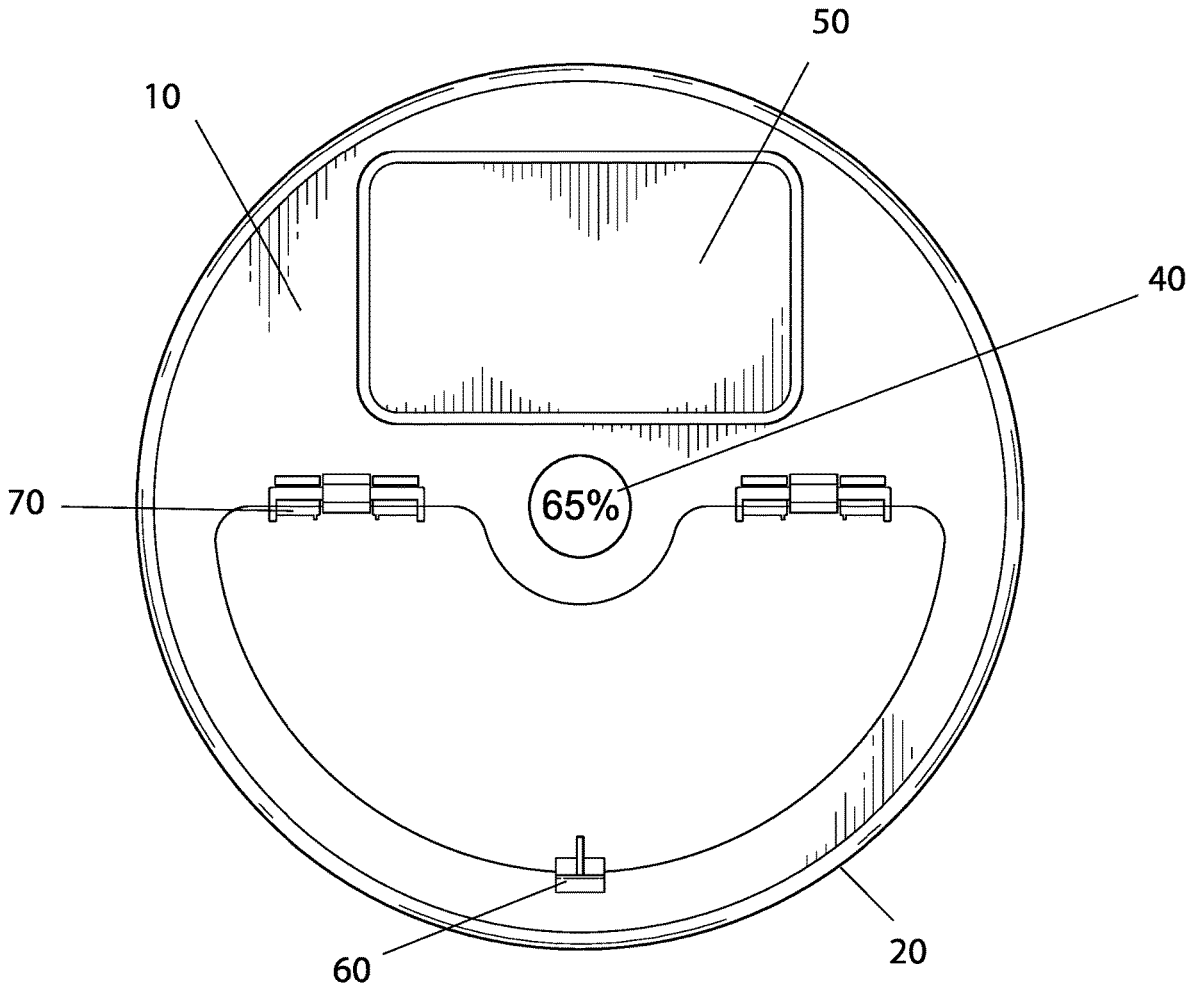
FIG. 2 is a top view of the lid for a container.
Figure 3:
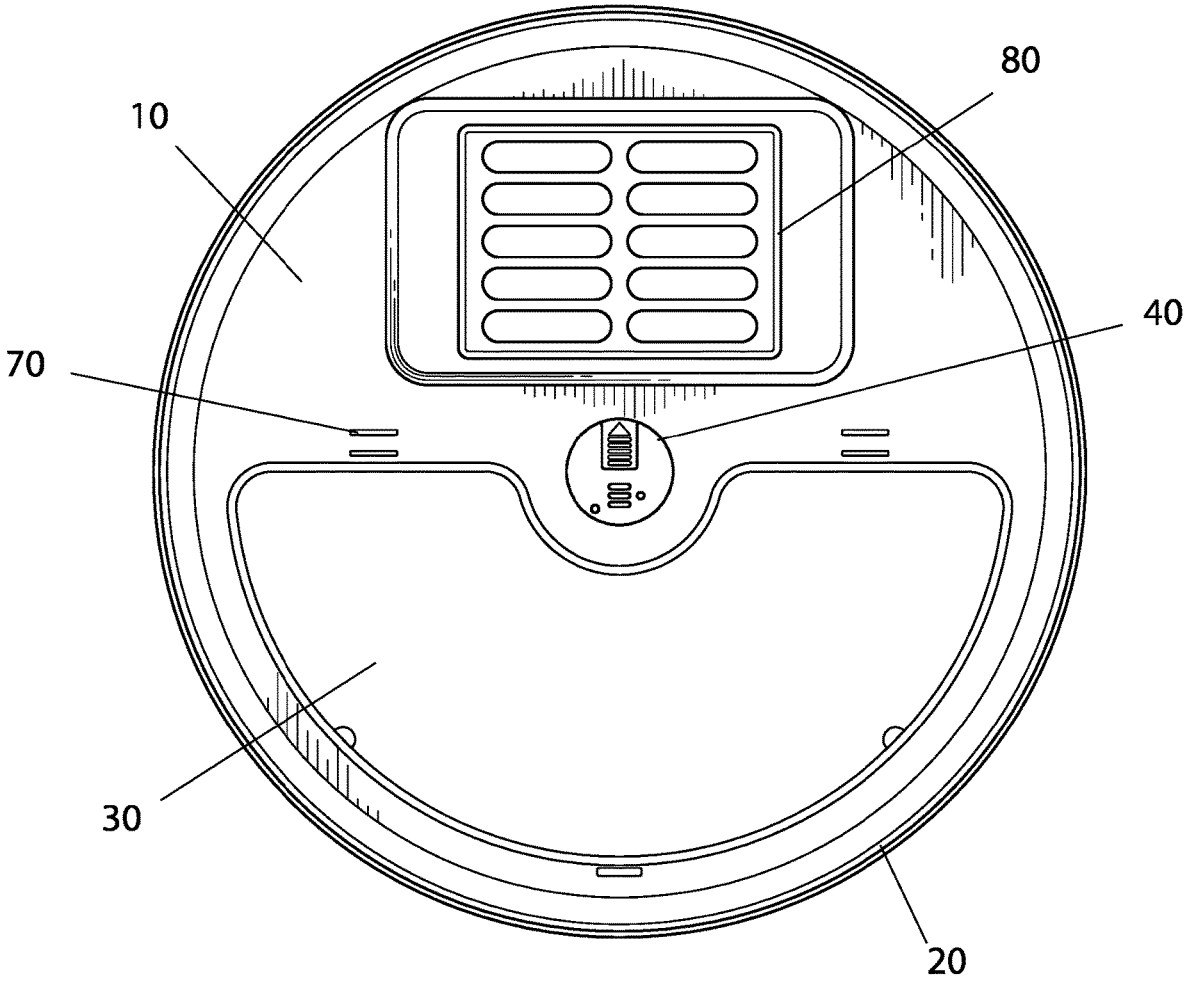
FIG. 3 is a bottom view of the lid for a container.

FIG. 2 is a top view of the lid 10. FIG. 3 is a bottom view of the lid 10. Referring to FIGS. 2 and 3, the hatch 30 may be configured to be shaped in semi-circle type formation. In an alternative embodiment, the hatch 30 may be shaped in a rectangle, triangle, square, diamond, pentagon, heptagon, hexagon, circle, or other shape that allows a user to open the hatch 30 and access the contents within a container. The hatch 30 is connected to the lid 10 via hinges 70 and it is secured in place via a lock 60. In a preferred embodiment, the hatch 30, may be securely locked via a snap fit lock 60. The hatch 30 in an alternative embodiment may be twist operated. In one embodiment, the lock 60 may be a snap fit joint, a friction fit lock or feature any other locking mechanism that is known to one of skill in the art. On the underside of the lid 10, there may be additional clips along the edges of the opening to the hatch 30 to help secure the hatch 30 closed. When the hatch 30 is closed, there is an airtight seal around the perimeter of the hatch so that minimal amounts of air or moisture can get into the container.

Referring to FIG. 3, the lid 10 features a hygrometer 40. In a preferred embodiment, the hygrometer 40 is centrally disposed within the lid 10 and it is used to measure the water vapor within the container environment (i.e., humidity). The hygrometer is a beneficial feature of the lid because many agricultural products that are stored in containers have an optimal level of humidity. The hygrometer 40 allows a user to monitor the humidity in a container and adjust it accordingly to meet the optimal range of humidity for each specific agricultural product. Accordingly, in a preferred embodiment, the lid 10 features a pocket 80 for housing humidity packs for controlling humidity in the container's environment. In a preferred embodiment, the pocket has vents or holes. In one embodiment, the pocket 80 may feature a shelf operationally configured to receive and store humidity packs. The pocket 80 may also feature a door that opens and closes to allow for secure placement of a humidity pack within the pocket 80. The humidity packs may be a pack that responds to the environment by adding or removing moisture using a combination of salts with water to regulate humidity. Humidity packs may also be packs that either keep environments moist (humectant) or keep environments dry by removing moisture (desiccants). Moreover, in a preferred embodiment, the hygrometer 40 may be illuminated so that the hygrometer may be read in the dark. This may be accomplished via a glow in the dark surface or with an internal light. In a preferred embodiment, the display for the hygrometer may also display the internal temperature of the container.

Figure 4:
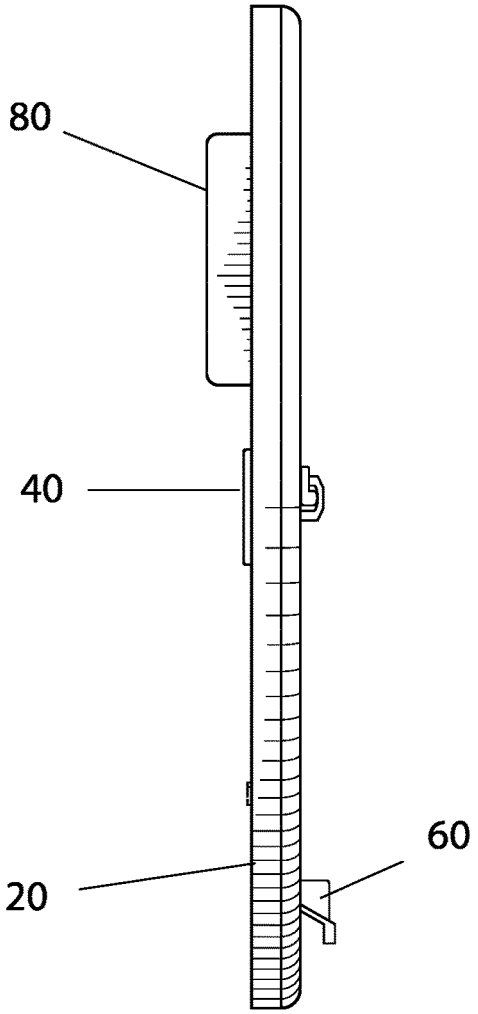
FIG. 4 is a left side view of the lid for a container.
Figure 5:
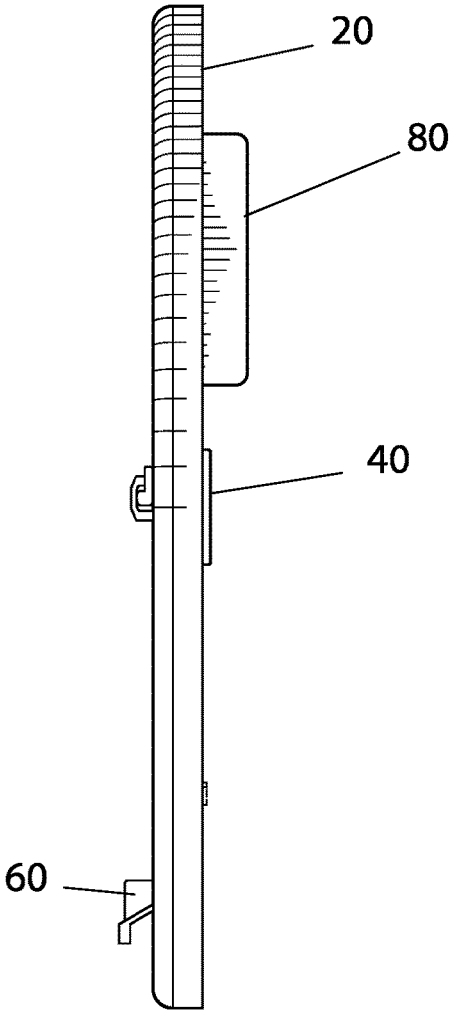
FIG. 5 is a right side view of the lid for a container.
Figure 6:
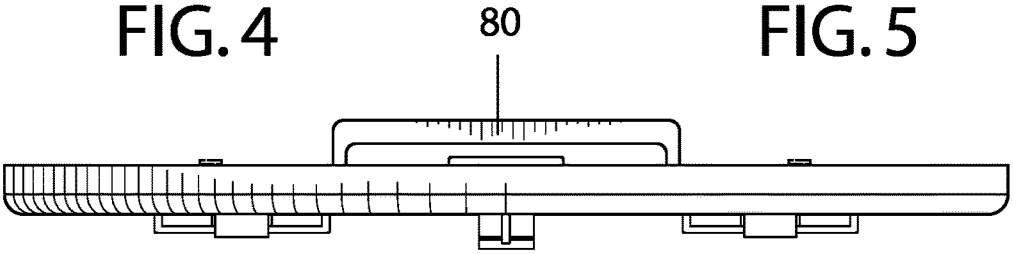
FIG. 6 is a top view of the lid for a container.
Figure 7:
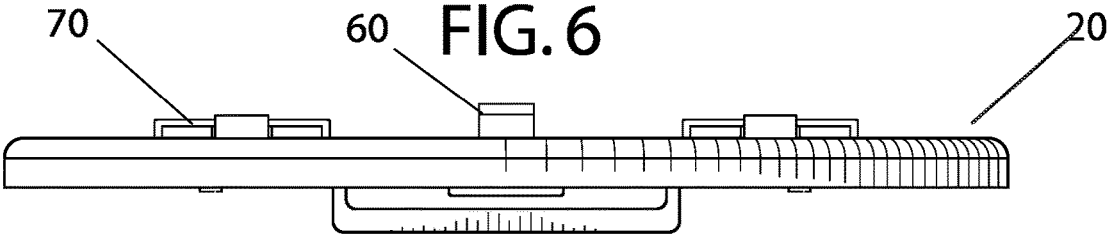
FIG. 7 is a bottom view of the lid for a container.
Figure 8:
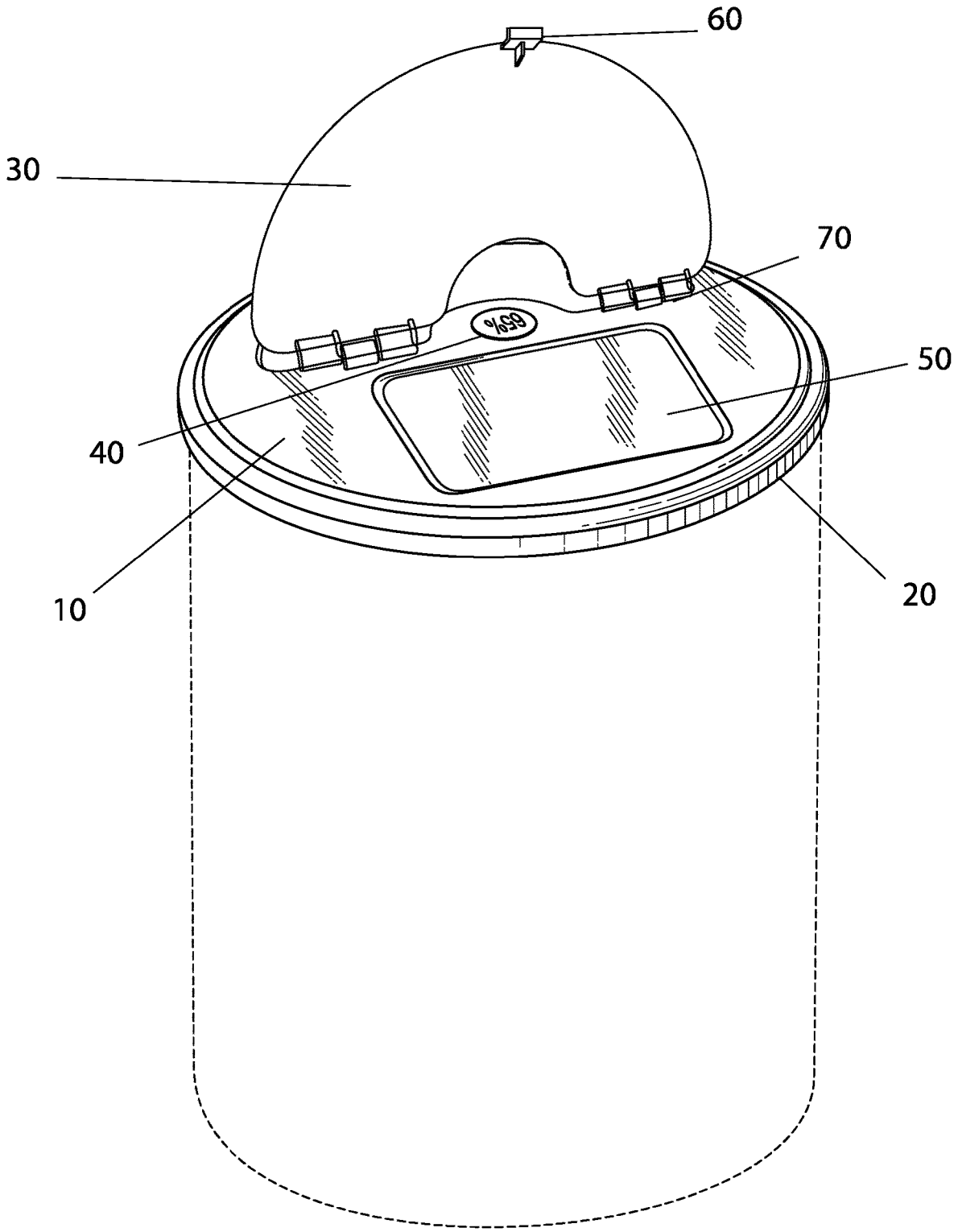
FIG. 8 is an environmental view of the lid for a container on a drum.

FIGS. 4 and 5 are side views of the lid 10. FIGS. 6 and 7 are front and back views of the lid 10. FIG. 8 is an environmental view of the lid 10 on a drum. In one embodiment, the lid 10 is made of a rigid plastic, such as high-density polyethylene or polypropylene. In a preferred embodiment, the lid 10 features a label 50 surface for labeling the lid to identify the contents of the container. The label 50 may be a surface wherein a sticker is placed in the area with the product written on the sticker. The label 30 may be a dry erase surface or a sticker with a dry erase surface so that the contents within a container may be erased and relabeled accordingly. In an alternative embodiment, the label may feature a chalkboard type surface or any other surface that allows a user to write on and erase the labeled contents.

In use, a user may place and secure a lid 10 to a drum or container. Once snapped over the edge of a container, the user may label the contents of the drum by writing on the label 50. A user may read the level of humidity within the container by reading the hygrometer 40 on top of the lid 10. Then, a user may access the contents of the container by opening the hatch 30. If the humidity needs to be adjusted, then the user may also open the hatch 30 and insert humidity packs into the pocket 80, which is located on the underside of the lid 10.

Figure 9:
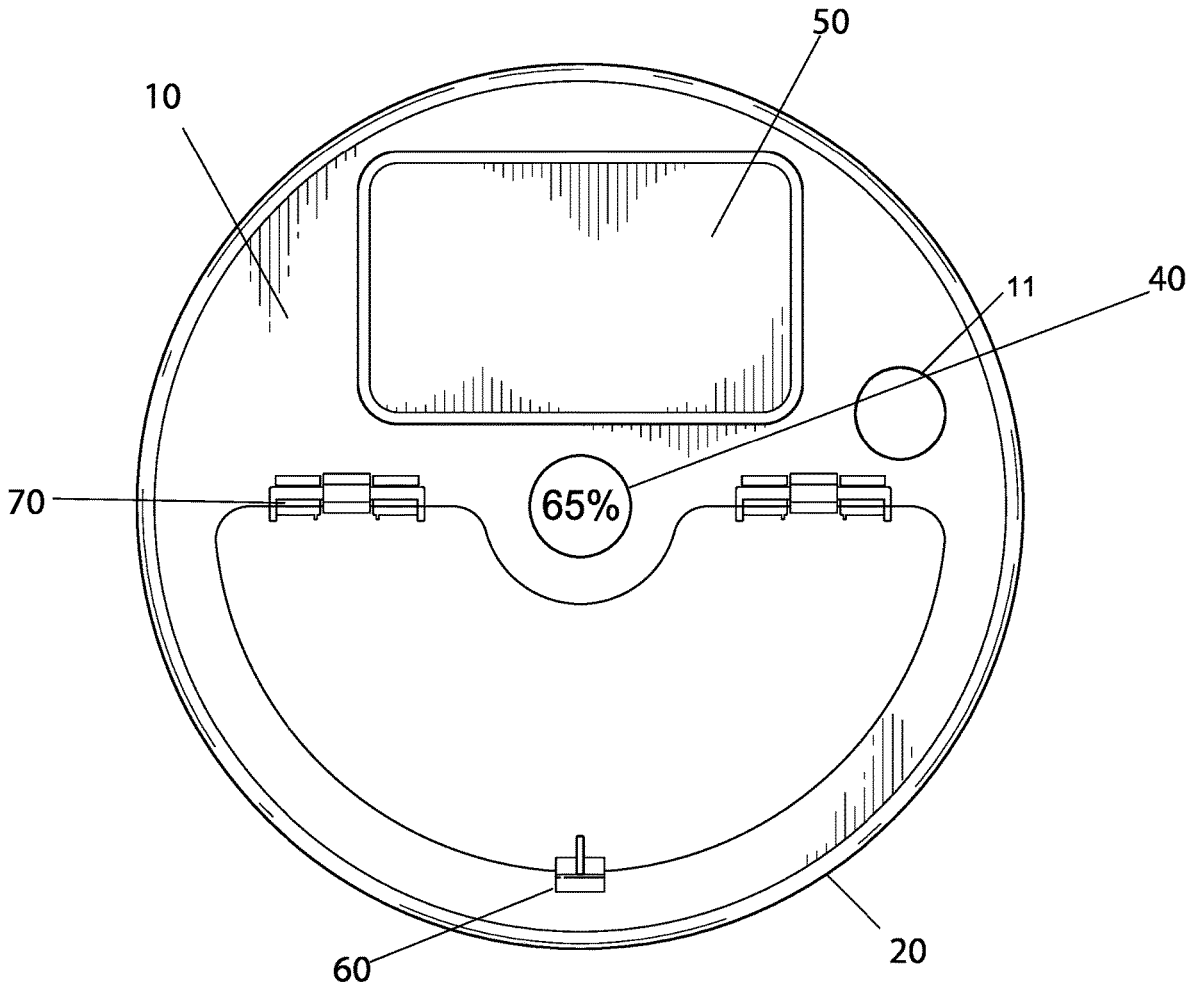
FIG. 9 is a top view of an alternate embodiment of the lid for a container.
Figure 10:
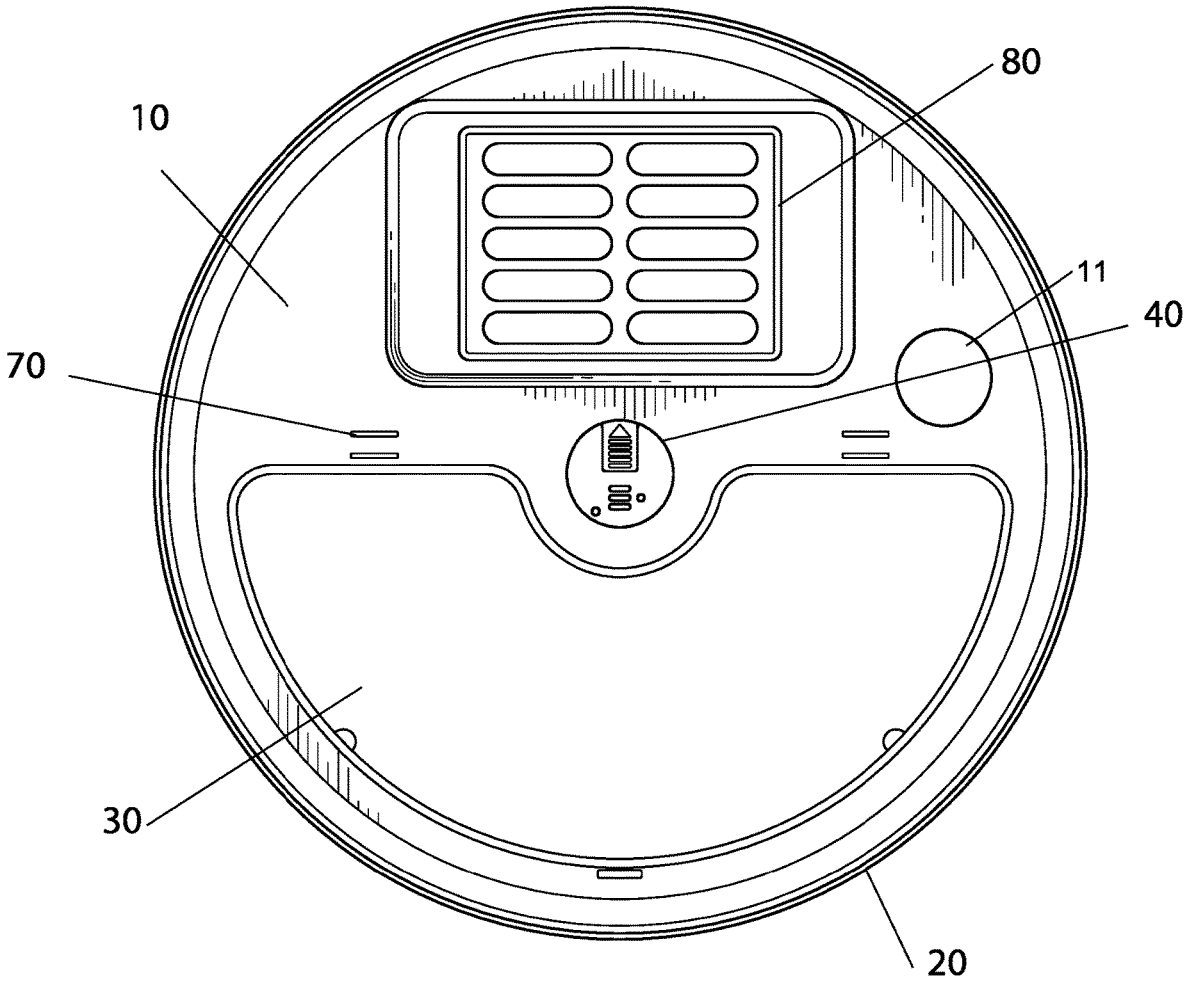
FIG. 10 is a bottom view of the alternate embodiment of the lid for a container.

FIGS. 9 and 10 are top and bottom views of an alternate embodiment of the lid 10 for a container (not shown). This alternate embodiment of the lid 10 features a valve 11. The valve 11 may be circular, elliptical, rectangular, or square. The valve 11 may provide means to allow for an automatic burp feature wherein humidity or temperature may be controlled by mixing ambient air and the container's air. The valve 11 may allow for, or regulate, air exchange between the container and the environment. The valve 11 may be controlled by a timer, a humidistat, manually, or via a mobile device wirelessly (Bluetooth).

As discussed above, the lid 10 may feature a hygrometer and/or thermometer 40. Suitably, the hygrometer and/or the thermometer 40 may be outfitted to transmit humidity and temperature data wirelessly to a computer or mobile device via Bluetooth. The humidity or temperature data may be sent to a web or mobile application wherein a user may be able to obtain said data to monitor metrics of the product in containers and control the valve 11.

Figure 11:
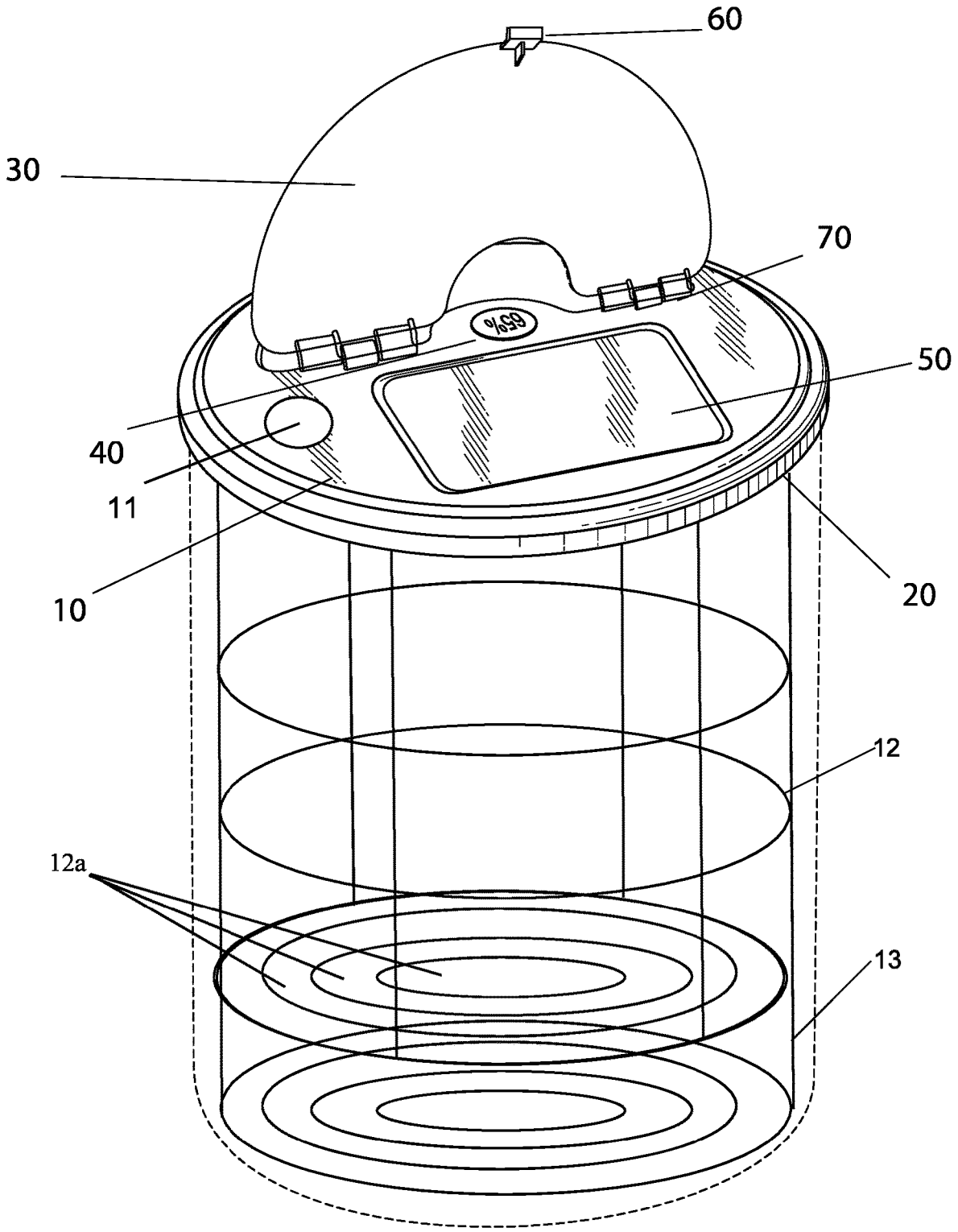
FIG. 11 is an environmental view of the alternate embodiment of the lid for a container on a drum.

FIG. 11 is an environmental view of an alternate embodiment of the lid 10 for a container on a drum (shown in broken lines). This embodiment of the lid 10 features an internal webbing 12 (also known as a cage or rack) which may have a plurality of horizontal, vertical, or circular components. The webbing 12 may be attached to the bottom of the lid 10, e.g., by hooks or by restriction fit or adhesive. Alternatively, the webbing 12 could be a standalone feature. In some embodiments, the webbing 12 may be made from plastic, metal, or wood. The webbing 12 may form a lining inside the container. The webbing 12 may be used to sort material by size while stored inside the container. The sorting of material is facilitated by gaps 12*a* in the webbing 12 which small material may fall though. The webbing may also feature an extract container 13. The extract container 13 may be used to further separate desirable material from the product as well. The extract container 13 may catch and isolate the smallest materials which fall from the product. As such, the extraction container catch surface may be a mesh fabric or even a rigid plastic so that the items may be retained thereon for removal from the container. The webbing and the extract container may be cylindrical in shape since product desirability may be a function of size, the geometry of the webbing 12 may be sized to allow material of a certain size to fall through webbing 12 while catching smaller material in the extract container 13. The dimensions of the webbing 12 will be subject to considerations of the sizes of desirable and undesirable material. Material sorting will be facilitated by moving or shaking the container to tumble the product. The main product may ideally stay in the webbing, small material may fall through the webbing 12 and the smallest material may be caught by the extract container 13.

Figure 12:
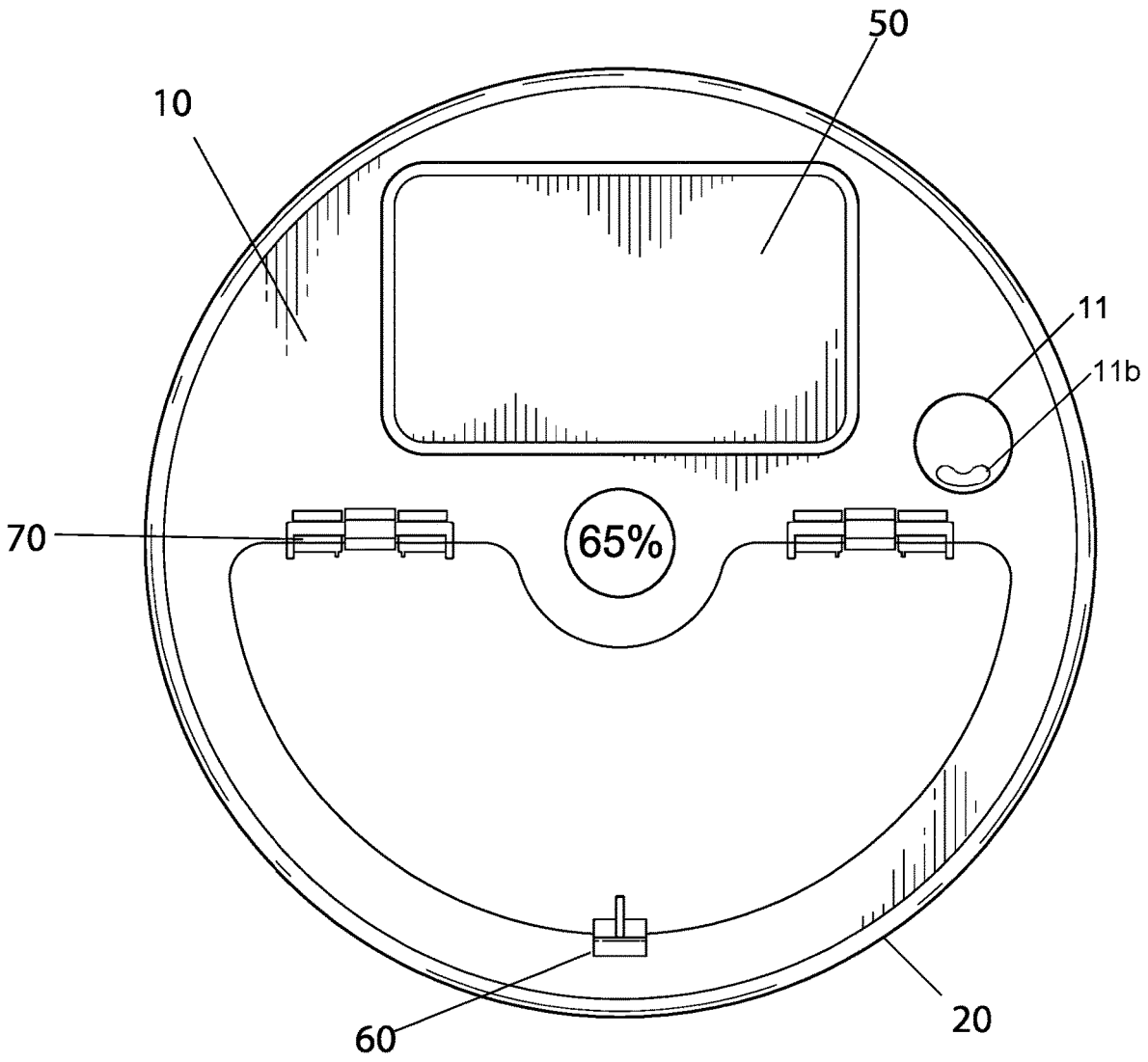
FIG. 12 is a top view of the alternate embodiment of the lid for a container on a drum.

FIG. 12 shows a top view of an alternative embodiment of the lid 10. This lid 10 is in most ways like the lid 10 shown in FIG. 9. However, the mechanism by which the valve 11 opens and closes is different. The valve 11 shown in FIG. 12, opens and closes by being rotated. The valve 11 shown in FIG. 12 is in a closed position. The valve is characterized by a void 11*b* which is a permanent hole in the valve 11. The closed position is defined by the void 11*b* leading to another flat surface, and not to the inside of the container (not shown).

Figure 13:
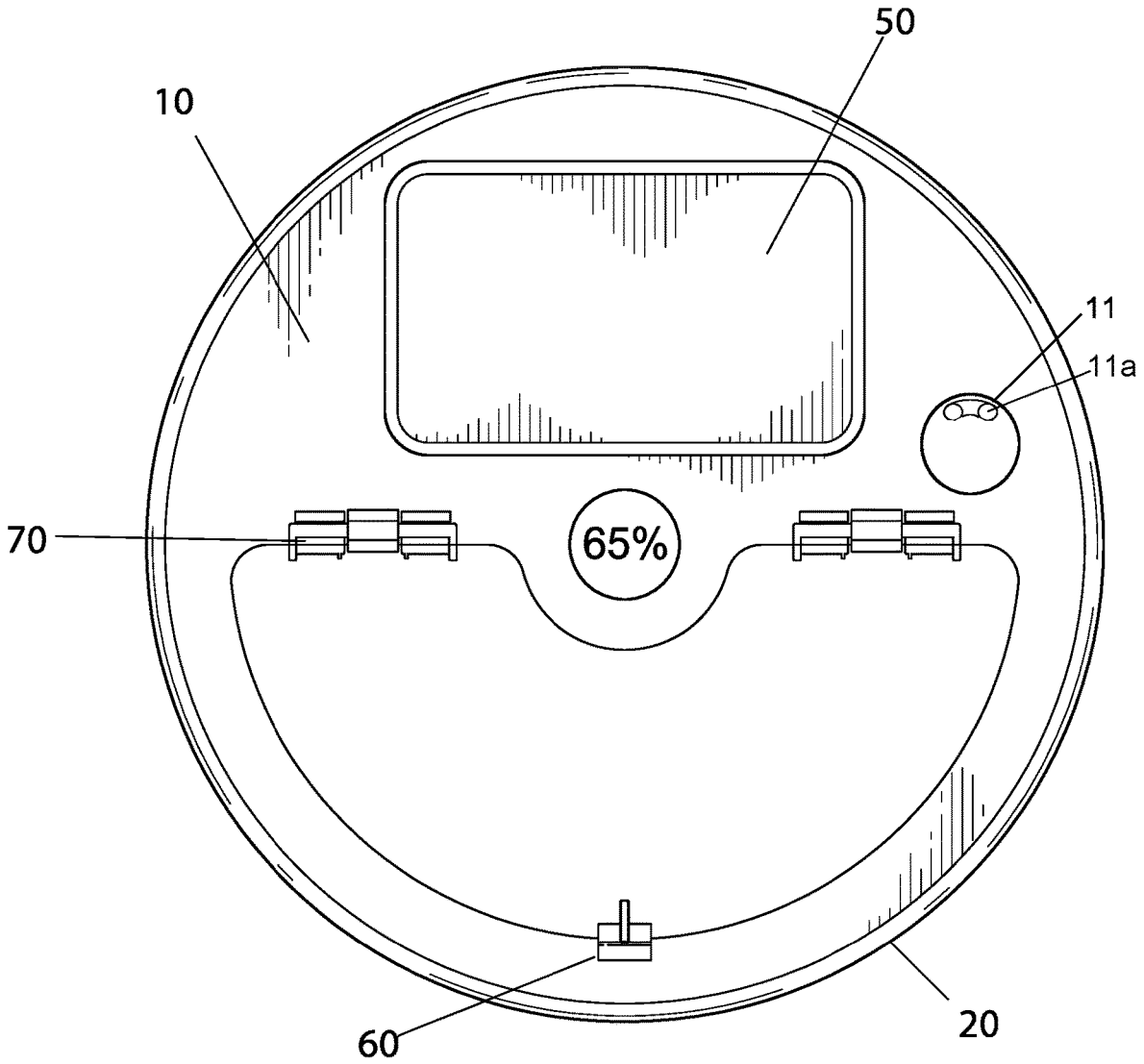
FIG. 13 is a top view of the alternate embodiment of the lid for a container on a drum.

FIG. 13 shows the valve 11 in an open position. The valve is open when the void 11*b* eclipses at least one valve hole 11*a*. The valve 11 moves from the closed position shown in FIG. 12 to the open one shown in FIG. 13 by rotating. As the valve 11 rotates, at least one valve hole 11*a* will appear. The valve hole 11*a* in conjunction with the void 11*b* may be used regulate air exchange between the inside of the container and ambient environment. The valve 11 shown may be rotated manually, via a small motor, via a motor and Bluetooth, or via a motor and a sensor. Speaking to sensors specifically, the valve 11 may be driven to rotate to modulate the humidity in the container by the hygrometer. The hygrometer may trigger rotation at certain humidity thresholds. This automatic modulation feature is called the "autoburp feature."

Figure 14:
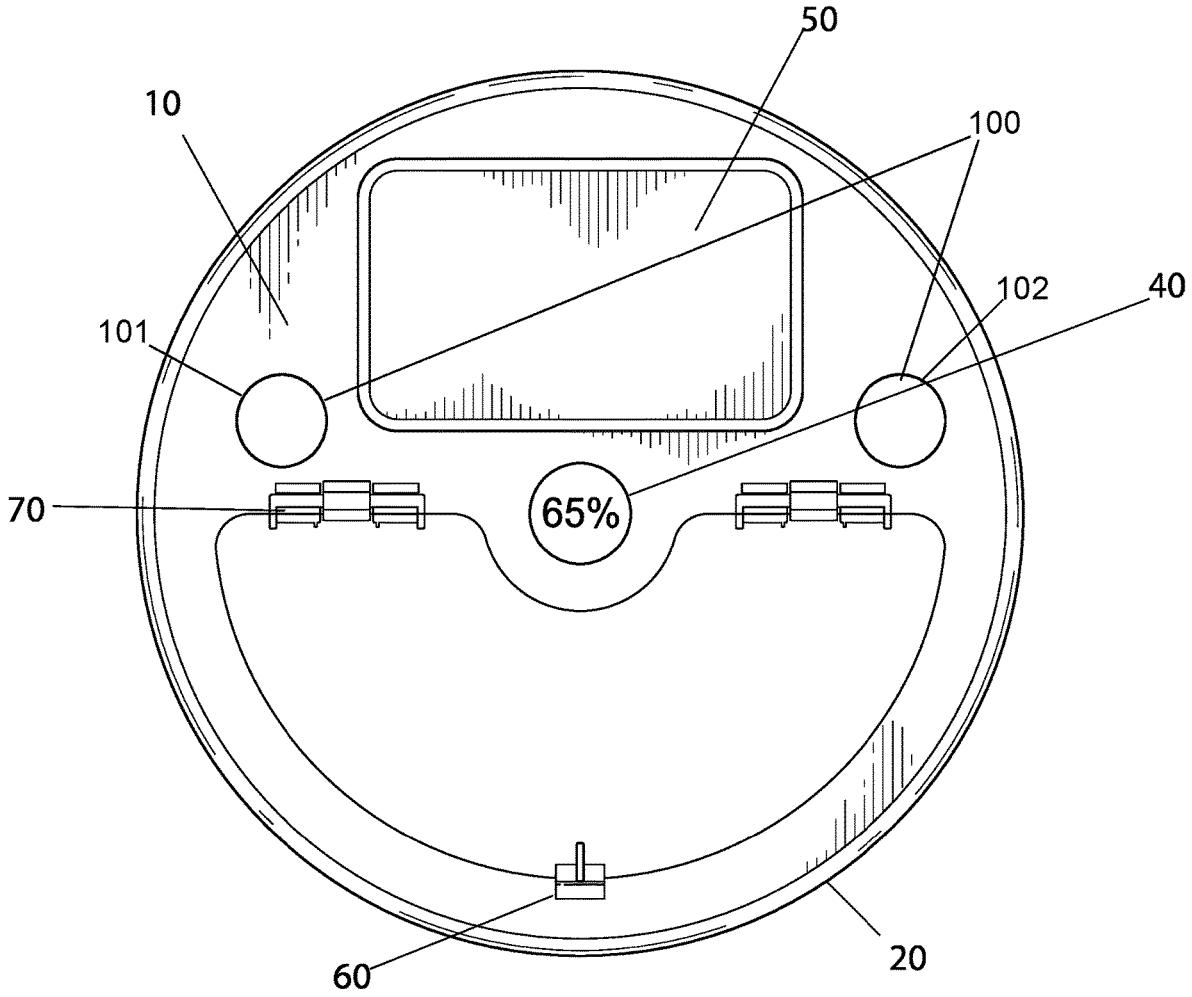
FIG. 14 is a top view of an alternate embodiment of the lid for a container on a drum.
Figure 15:
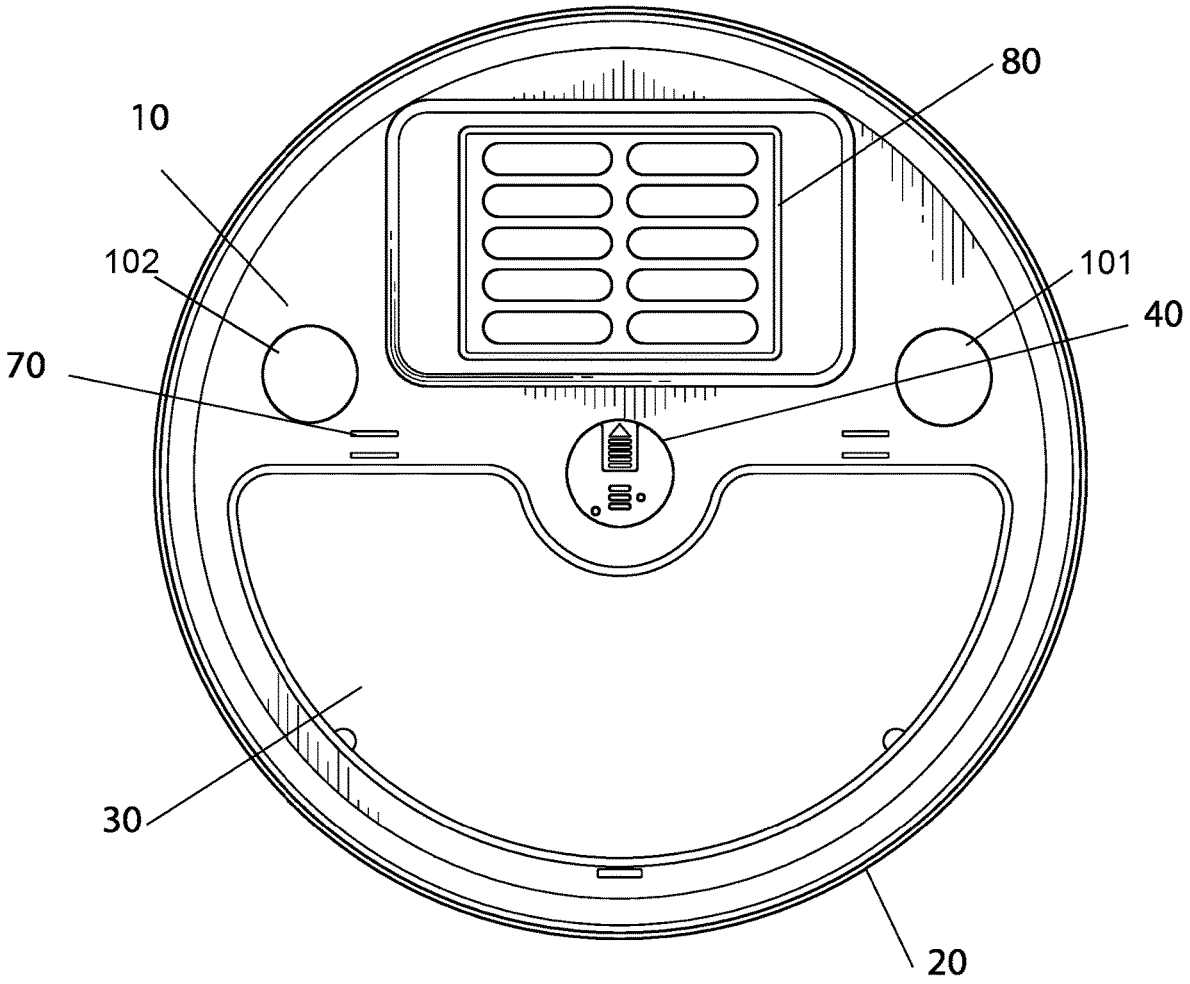
FIG. 15 is a bottom view of the alternate embodiment of the lid for a container on a drum.

FIGS. 14 and 15 show the lid 10 with the autoburp feature in an alternate embodiment equipped with two powered pumps 100 to automatically regulate the humidity more precisely within the container. In a preferred embodiment, the pumps 100 may be powered by batteries, although in alternate embodiments could be powered through a connection to electrical outlets, solar power, external generators, or other power sources. The powered pumps 100 connect to the hygrometer 40 that monitors the humidity within the container and may trigger the autoburp feature at a specifically defined humidity level to drop the humidity back down to a predetermined base level, similar to how a thermostat in a room may be set to a specific temperature to then automatically regulate that room's temperature with an air conditioner. When the container's humidity level reaches the set point, the powered intake pump 101 may pull dry air into the container's interior while at the same time the powered exhaust pump 102 may blow the moist air out of the container's interior to automatically lower the humidity to the predetermined level. In a preferred embodiment, the powered pumps 100 may be equipped with standard nipple valves to remain airtight when not in use, although may also be a ball valve, gate valve, compression valve, electromagnetic valve, or other airtight valve that can be automatically opened to allow air passage. The lid 10 may also be equipped with a hatch 30, label 50, lock 60, hinges 70, and pocket 80 that function as discussed above.

Figure 16:
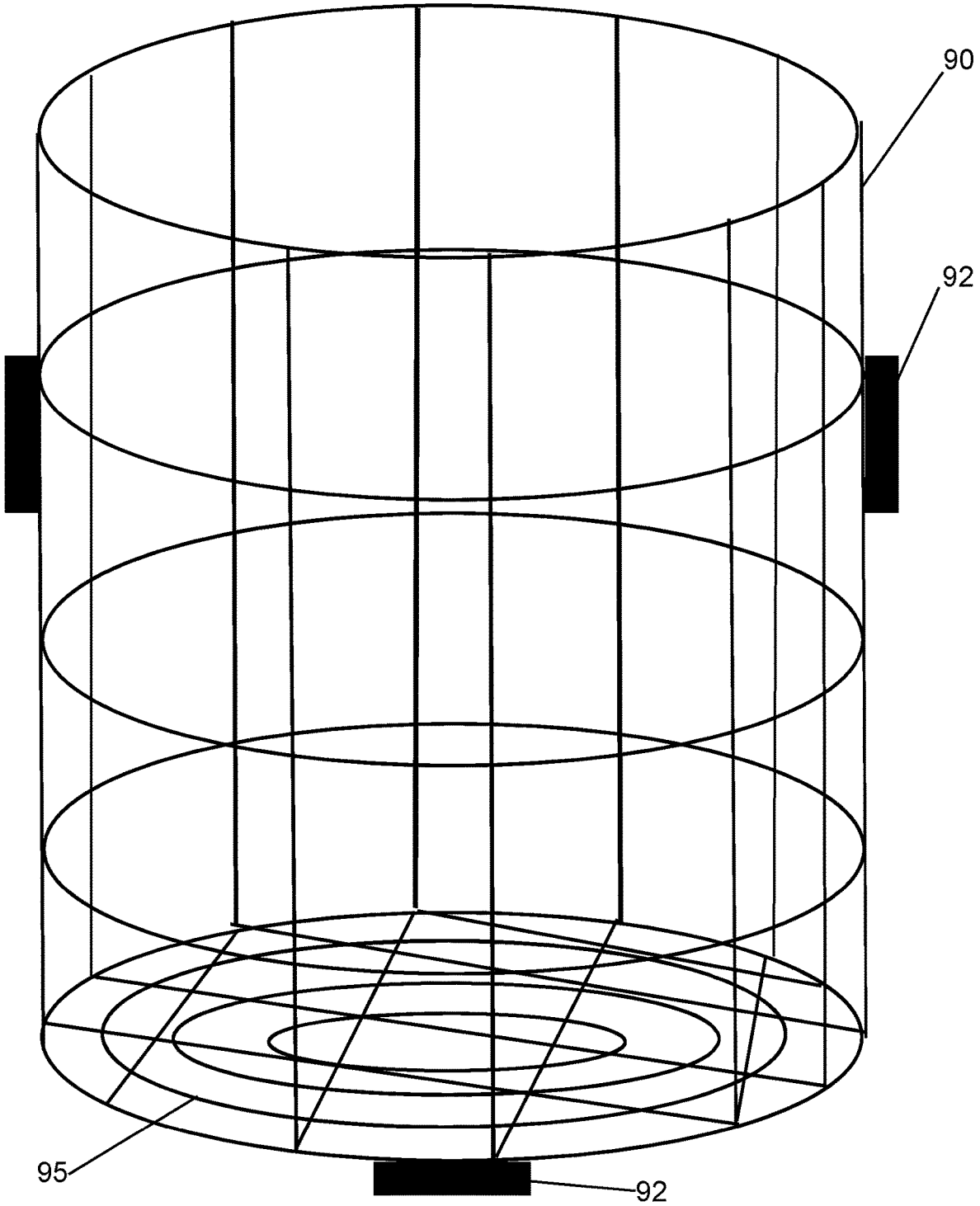
FIG. 16 is a perspective view of a lattice insert with sifter screen and spacers for a container.

FIG. 16 shows a perspective view of a lattice insert 90 with a sifter screen 95 and spacers 92 for a container. In a preferred embodiment, the lattice insert 90 may be made of a sturdy plastic such as a high density polyethylene or polypropylene, although in alternate embodiments may also be made of other suitable materials including metal, wood, or glass. The lattice insert 90 may be cylindrical in shape and removable from the container, and when inserted into the container may be separated from the container's interior with multiple spacers 92 that hold the lattice insert 90 approximately one-to-two inches away from the container's interior wall; the spacers 92 may also be made of a high density plastic, although could also be made of metal or wood. The lattice insert 90 functions as a trimmer for the agricultural product stored inside, so that when the container is rotated, such as with the use of a tumbler, the lattice structure may catch dry leaf matter and automatically trims and separates it outside of the lattice insert 90. The lattice insert 90 may also contain a removable sifter screen 95, which in a preferred embodiment may also be made of a high density plastic, although in alternate embodiments may be made of other suitable materials such as metal, wood, or glass. The sifter screen 95 functions similarly to the lattice insert 90 as both separate the larger agricultural material from the smaller material that has been trimmed and fallen outside the lattice 90 and sifter screen 95. The sifter screen 95 is positioned opposite the lid 10, towards the bottom of the container so that when the container is set upright the sifter screen 95 may catch the larger agricultural product and allows the smaller, trimmed pieces to fall through to the bottom of the container.

Figure 17:
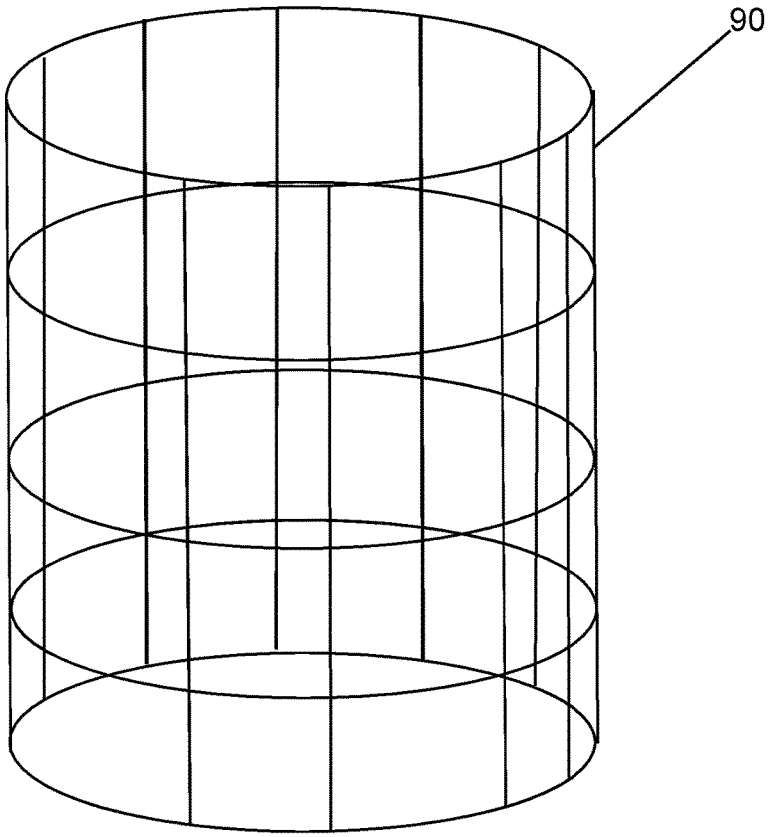
FIG. 17 is a perspective view of the lattice insert for a container.
Figure 18:
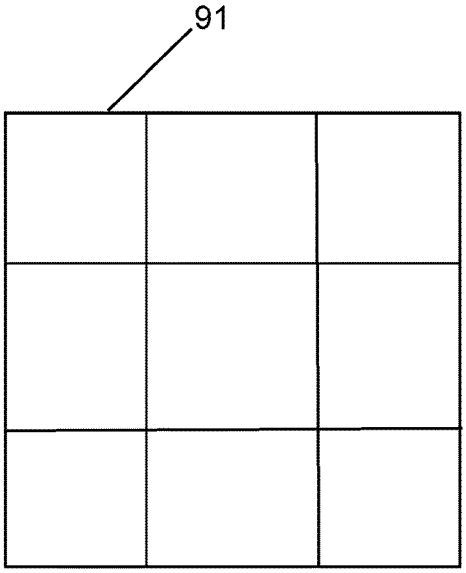
FIG. 18 is a zoom-in view of a wall of the lattice insert for a container.

FIGS. 17 and 18 show other views of the lattice insert 90 for a container, with FIG. 18 showing a zoom-in view of the wall 91 of the lattice insert 90; the wall's 91 preferred embodiment is a crisscross pattern with multiple equally-sized squares, although alternate embodiments may feature differently-sized squares, triangles, circles, rectangles, or other repeating shape set in a similarly-styled lattice pattern. The squares of the lattice wall 91 may preferably be ½ to ¾ inches in size to best catch and trim the dried leaf matter within the container and to allow it to pass through the lattice insert 90, although in alternate embodiments the squares may be larger or smaller to adjust for the desired amount of trimming and size of sifting for the agricultural product within the container.

Figure 19:
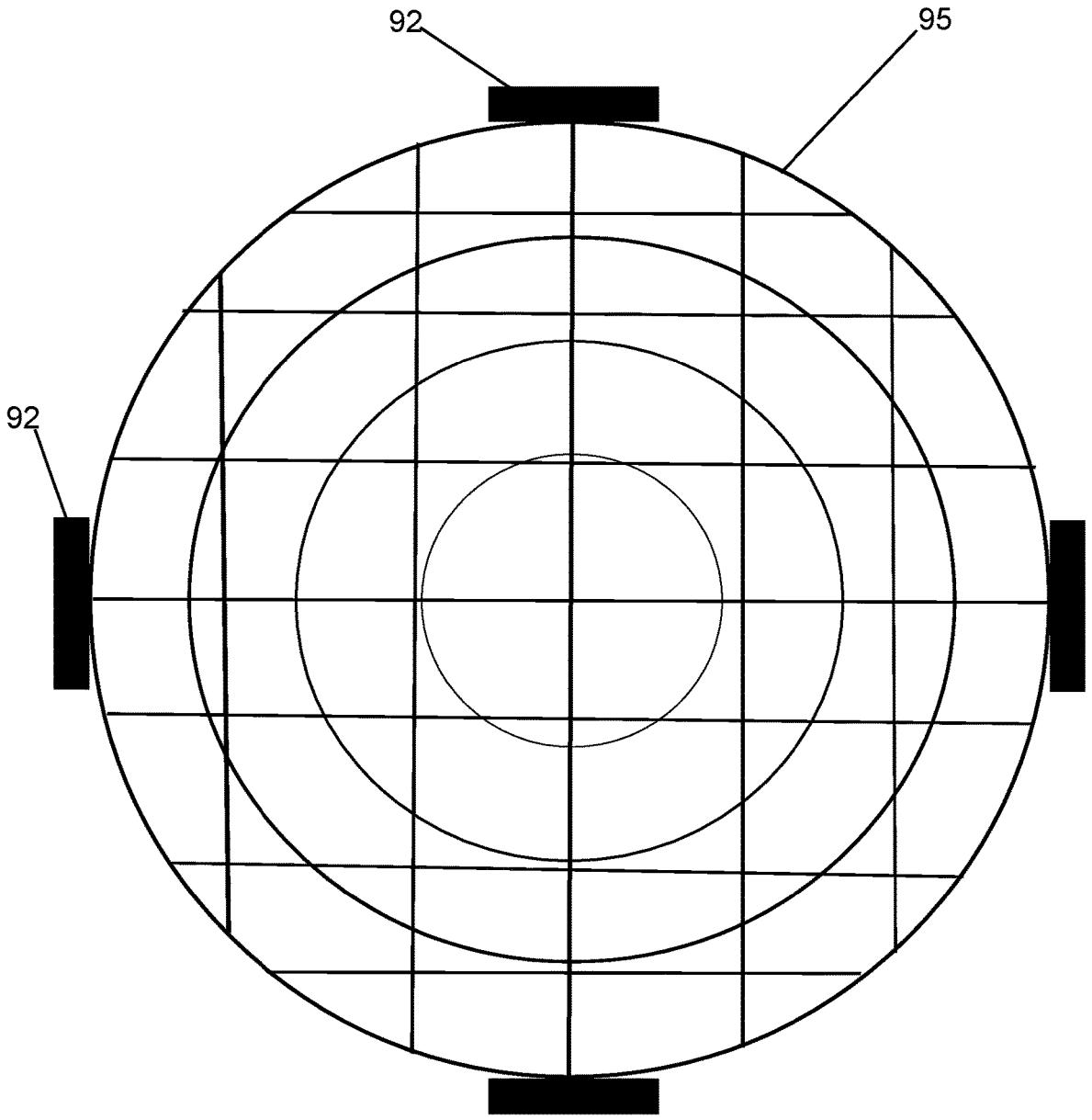
FIG. 19 is a bottom view of the lattice insert with sifter screen and spacers for a container.

FIG. 19 shows the sifter screen 95 from a bottom view of the lattice insert 90, where the sifter screen 95 is set opposite the lid 10 of a container; the sifter screen 95 may also preferably have an equally-shaped lattice pattern to properly sift the smaller, trimmed plant material from the larger material held within the lattice insert 90, and, as described for the lattice wall 91 in alternate embodiments may be differently sized to separate and sift out differently-sized trimmings of the agricultural product within the container.

Figure 20:
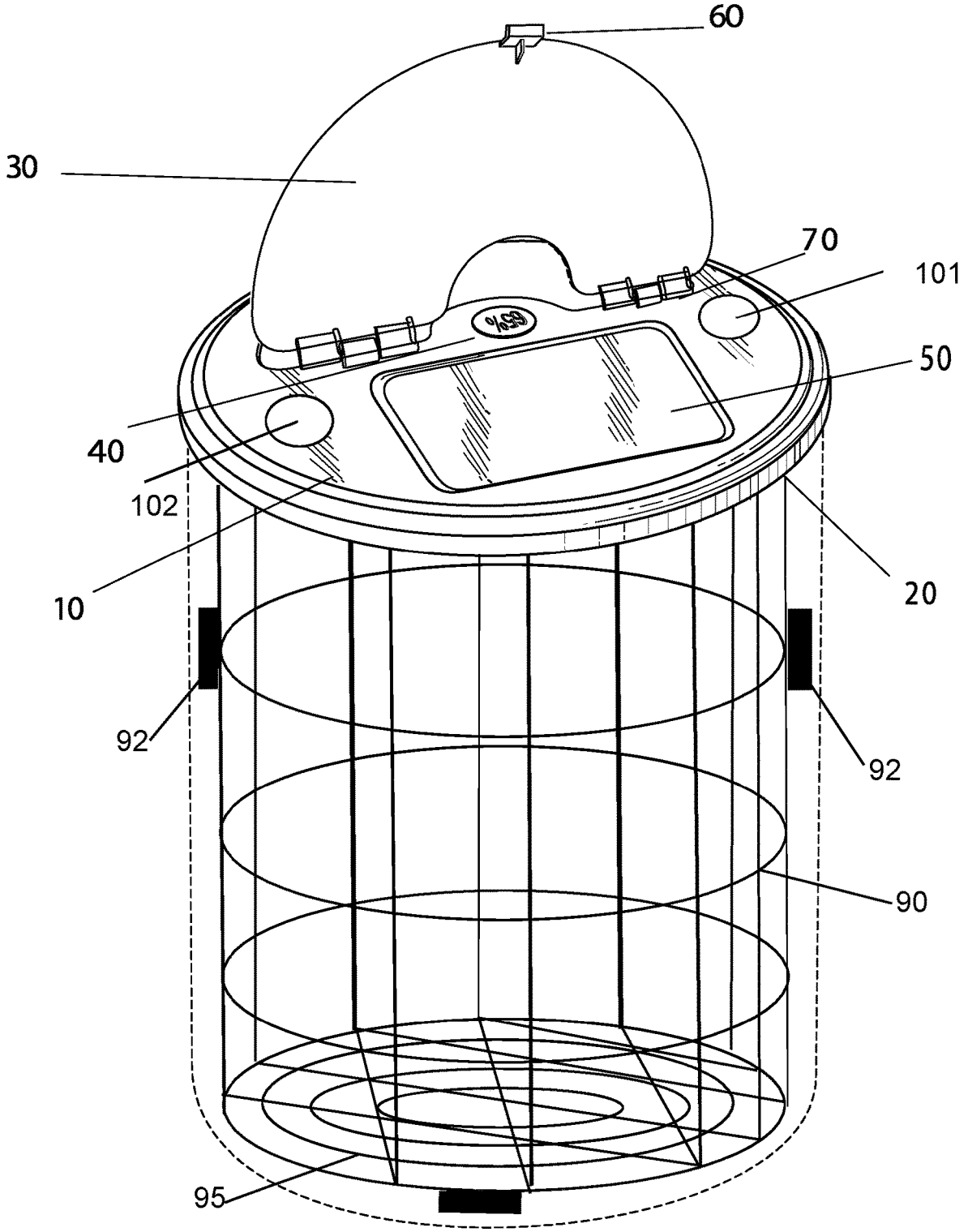
FIG. 20 is an environmental view of the alternate embodiment of the lid and lattice insert with sifter screen and spacers for a container on a drum.

FIG. 20 shows an environmental view of the alternate embodiment of the lid 10 and lattice insert 90 with sifter screen 95 and spacers 92 set within a container; the lattice insert 90 may rest on the spacers 92 that separate the lattice and sifter screen from the container's interior walls. As described above, agricultural product may be stored inside the container, which is closed with the lid 10 that may contain a hatch 30 to allow access to the container's interior. The lid 10 may be equipped with two powered pumps 100 that, when triggered by the hygrometer 40, may turn on to both pump dry air into the container with the intake pump 101 and pump moist air out of the container with the powered exhaust pump 102 to balance the container's humidity and return it to the user's specified level. The lattice insert 90 may be placed in the container before the container is filled, may be separated from the container by the spacers 92, and may separate the agricultural product from the container's interior walls; when the container is rotated, such as with a tumbler, the agricultural product may be caught by the lattice walls 91 and the trimmed portions fall through the lattice insert 90 and the sifter screen 95 to allow for easy sorting and separation.

Figure 21:
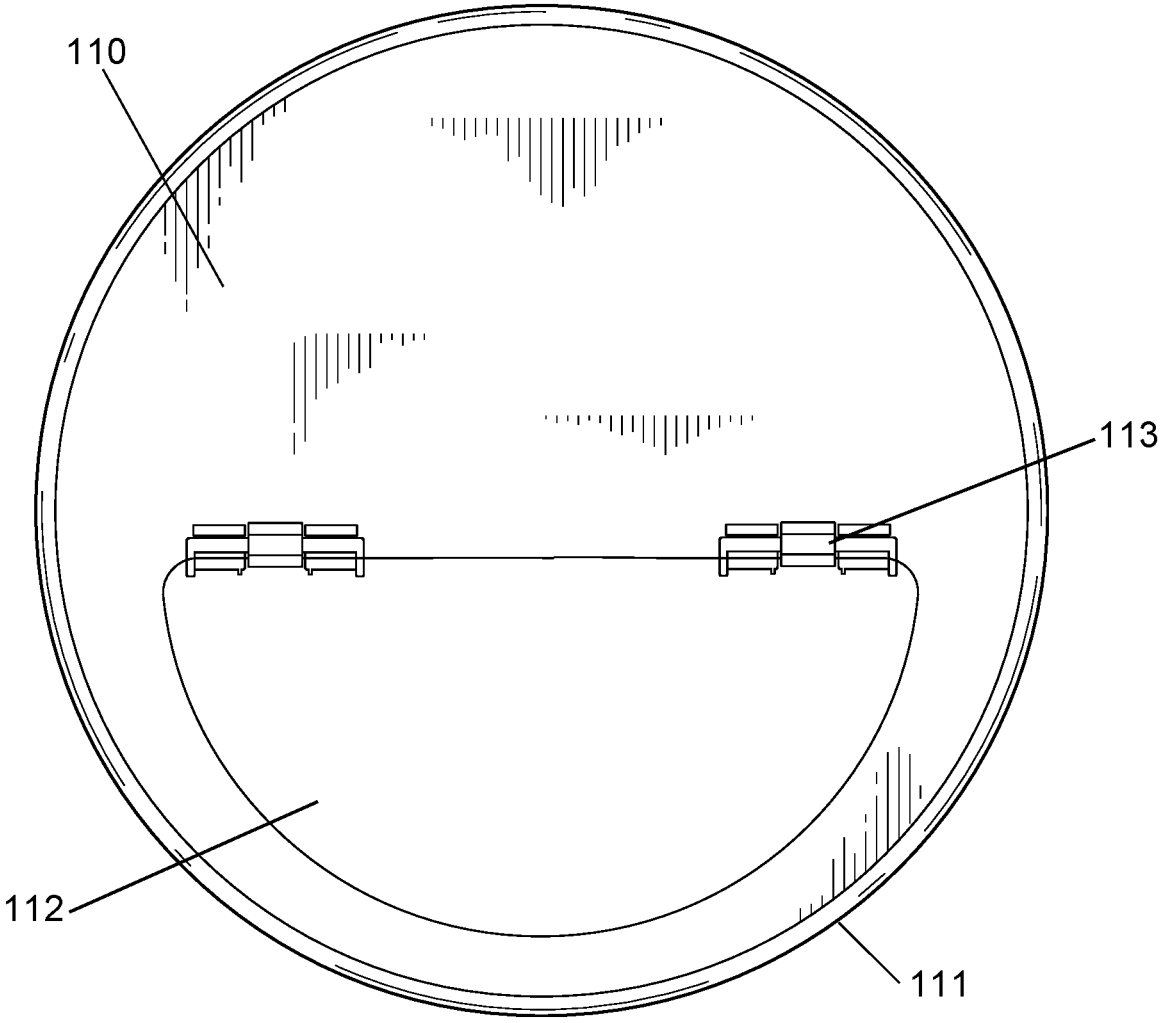
FIG. 21 is a top view of an alternate embodiment of the lid for a container on a drum.

FIG. 21 shows another alternate embodiment of a lid 110 with a simple locking trap door hatch 112 that may be on the bottom of a container to allow for easy access to the material inside without the need to empty the container of all contents. The trap door hatch 112 on the bottom may be offset to one side to allow a single user to perch a large container or drum on a ledge with the hatch 112 hanging off the edge, allowing the single user to easily empty the contents at the bottom of the container without needing to support the whole weight of the container. The lid 110 may contain trap door hinges 113 that may allow the trap door hatch 112 to swing open and closed while remaining attached to the lid 110.

Figure 22:
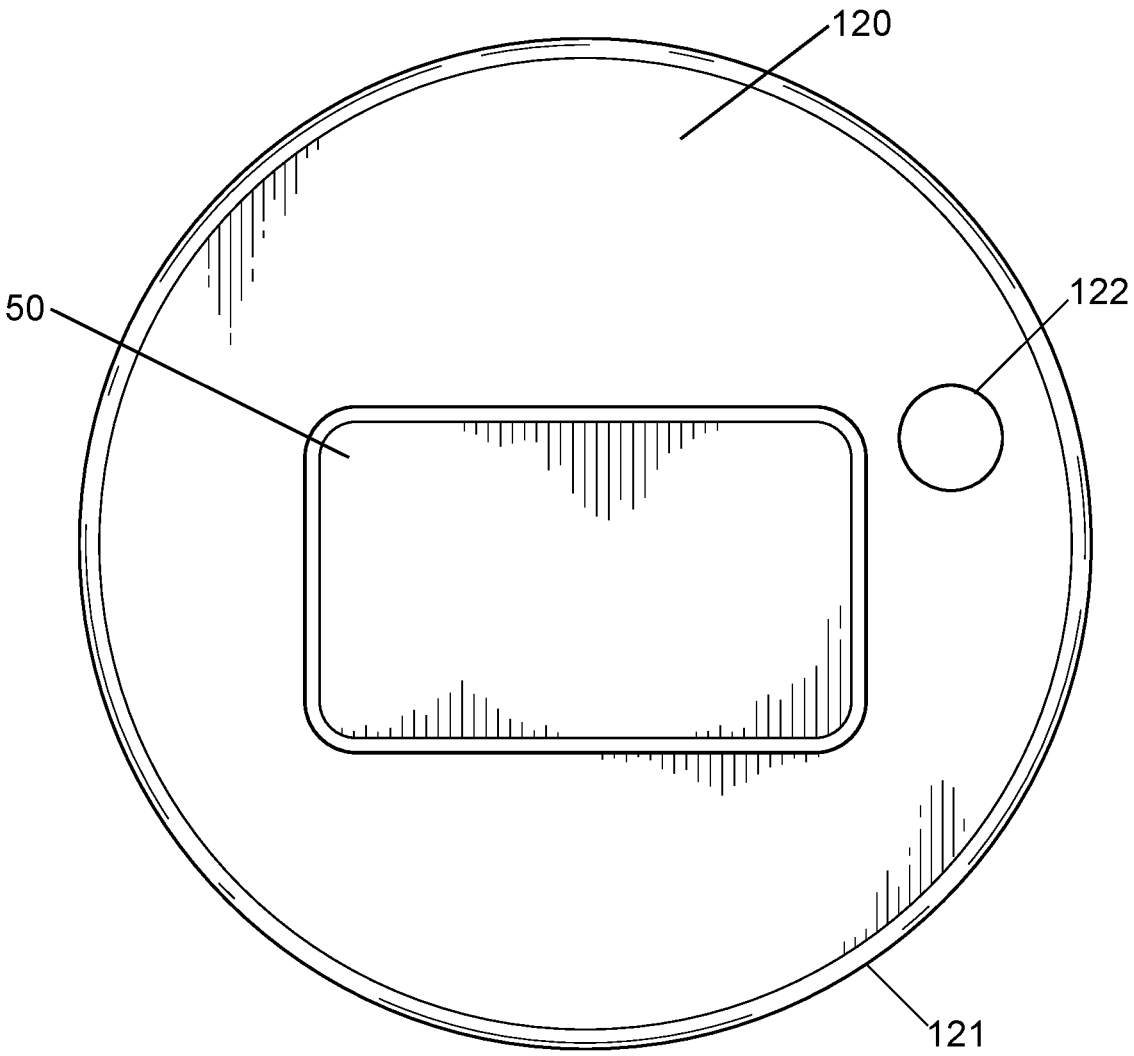
FIG. 22 is a top view of an alternate embodiment of the lid for a container on a drum; and, FIG. 23 is a bottom view of the alternate embodiment of the lid for a container on a drum.
Figure 23:
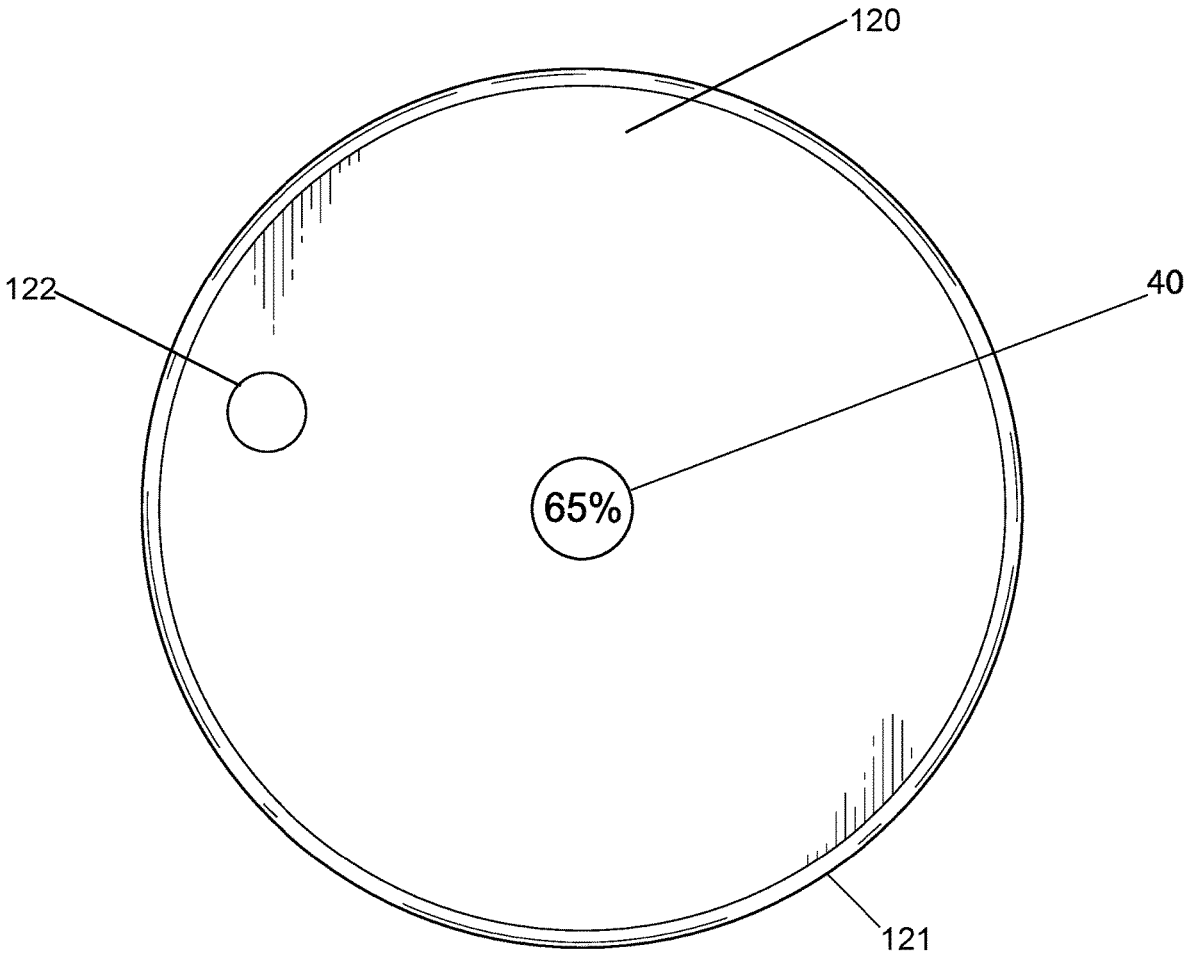

FIGS. 22 and 23 show another alternate embodiment of a lid 120 that may preserve the contents within a container for long-term storage by providing protection from oxidization. FIG. 22 shows the top of the lid 120 that, in a preferred embodiment, may be made of a single piece of plastic because of its durability, although in alternate embodiments may be made of other suitable, long-lasting material such as metal or wood; the lid 120 may be a single piece to better seal the container's contents for long-term storage, and features an airtight preservation rim 121 that creates a tight seal on the container and does not allow for repeated access to the container's interior. The lid's 120 top features only a label 50, that, as described above, allows a user to label the contents of the interior, and a preservation valve 122. In a preferable embodiment, the preservation valve 122 may be a nipple valve that connects to a powered pump and does not allow for airflow when closed, although in an alternate embodiment may be any other sealable valve that can connect to a powered pump and does not allow for airflow when closed.

The preservation valve 122 solves the difficulties of long-term storage, transportation, and preservation of certain agricultural products difficult due to the oxidizing effects of regular, atmospheric air; the preservation valve 122 may allow the container to be filled with other non-oxidizing gasses allow for long-term storage without detrimental effects on the agricultural product. The preservation valve 122 may allow a user to extract the air within the container, and then refill the container with another non-oxidizing gas, such as nitrogen, that better preserves the agricultural product within the container for a longer period than would be possible with regular, oxidized air while the container is stored or transported for a long period of time. FIG. 23 shows the bottom of the preservation lid 120, and may be equipped with a hygrometer 40 that, as described above, is wirelessly connected to a smart phone or a computer to provide the user with the container's humidity levels during the long-term storage.

Although the method and apparatus is described above in terms of various exemplary embodiments and implementations, it should be understood that the various features, aspects and functionality described in one or more of the individual embodiments are not limited in theft applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus, the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known," and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to," or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

We claim:

1. A lid for transforming a non-humidity controlled container into a humidity controlled container, said lid comprising:

a topside and an underside;

a webbing connected to the underside of the lid;

an extract container connected to the webbing;

an interior lattice insert;

a first half and a second half;

a circular rim configured to attach to the non-humidity controlled container of a specified diameter, thus transforming the non-humidity controlled container into the humidity controlled container;

a hygrometer, located on the topside of the lid, wherein the hygrometer is adapted to monitor and digitally display the humidity within the humidity controlled container;

a semi-circular hatch positioned over an opening through the lid wherein the opening is located within the first half of the lid, wherein the hatch is electively openable and closeable over the opening so that contents within the humidity controlled container may be accessed via the opening without removing the lid from the humidity controlled container;

a rectangular pocket located within the second half of the lid, wherein the pocket is located on the underside of the lid and is occupied by at least one humidity pack; and, a rectangular label surface that is located within the second half of the lid on the topside of the lid and opposite the pocket, whereby a user may write down information about the contents of the humidity controlled container.

2. The lid of claim 1 further comprising a closable valve which is configured to connect the topside and the underside of the lid, wherein the valve is opened and closed automatically and is controlled by a timer or humidistat.

3. The lid of claim 2 wherein the valve is opened and closed by a computer or a mobile device wirelessly.

4. The lid of claim 2, wherein the valve is a rotating valve.

5. The lid of claim 1 wherein the webbing and the extract container are cylindrical in shape.

6. The lid of claim 1 wherein the humidity controlled container is selected from the group consisting of a fiber container and a plastic container.

7. The lid of claim 1 wherein the interior lattice insert is a cylinder.

8. The lid of claim 7 wherein the insert is made of plastic.

9. The lid of claim 8 wherein the insert is spaced 1 to 2 inches away from the interior of the humidity controlled container.

10. The lid of claim 9 wherein the lattice insert consists of a lattice pattern with ½ inch to ¾ inch squares.

11. The lid of claim 1, wherein the hatch further comprises a locking mechanism configured to lock the hatch to the lid.

12. The lid of claim 1, wherein the lid is constructed with different diameters to match a plurality of different sized humidity controlled containers.

* * * * *